US010174561B2

(12) United States Patent
Hall et al.

(10) Patent No.: US 10,174,561 B2
(45) Date of Patent: Jan. 8, 2019

(54) POLYCRYSTALLINE DIAMOND CUTTING ELEMENTS WITH TRANSITION ZONES AND DOWNHOLE CUTTING TOOLS INCORPORATING THE SAME

(71) Applicant: SMITH INTERNATIONAL, INC., Houston, TX (US)

(72) Inventors: David R. Hall, Provo, UT (US); Ronald B. Crockett, Provo, UT (US); Neil Cannon, Provo, UT (US); Dwain Norris, Provo, UT (US); Madapusi K. Keshavan, The Woodlands, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 894 days.

(21) Appl. No.: 14/533,716

(22) Filed: Nov. 5, 2014

(65) Prior Publication Data

US 2015/0129322 A1 May 14, 2015

Related U.S. Application Data

(60) Provisional application No. 61/901,910, filed on Nov. 8, 2013.

(51) Int. Cl.
*E21B 10/573* (2006.01)
*E21B 10/55* (2006.01)
(Continued)

(52) U.S. Cl.
CPC ..... *E21B 10/5735* (2013.01); *B24D 3/06* (2013.01); *B24D 18/0009* (2013.01);
(Continued)

(58) Field of Classification Search
CPC ..... E21B 10/52; E21B 10/55; E21B 10/567; E21B 10/5673; E21B 10/5735
See application file for complete search history.

(56) References Cited

U.S. PATENT DOCUMENTS 4,694,918 A * 9/1987 Hall ..... B22F 7/06 175/414
5,304,342 A * 4/1994 Hall, Jr. ..... B01J 3/062 419/11

(Continued)

FOREIGN PATENT DOCUMENTS

EP 2610426 A2 7/2013
WO 2011011290 A2 1/2011

OTHER PUBLICATIONS

International Preliminary Report on Patentability issued in International Patent Application PCT/US2014/064455 dated May 19, 2016. 12 pages.

(Continued)

*Primary Examiner* — Nicole Coy

(57) ABSTRACT

A cutting element may include a substrate including a plurality of metal carbide particles and a first metal binder having a first metal binder content; an outer layer of polycrystalline diamond material at an end of the cutting element, the polycrystalline diamond material including a plurality of interconnected diamond particles; and a plurality of interstitial regions disposed among the interconnected diamond particles, the plurality of interstitial regions containing a second metal binder having a second metal binder content. The cutting element also includes at least one transition zone between the substrate and the outer layer, the at least one transition zone including a plurality of refractory metal carbide particles and a third metal binder having a third metal binder content, the third metal binder content being less than the first metal binder content and the second metal binder content.

15 Claims, 9 Drawing Sheets

(51) Int. Cl.

| | |
|---|---|
| ***E21B 10/567*** | (2006.01) |
| ***B24D 3/06*** | (2006.01) |
| ***B24D 18/00*** | (2006.01) |
| ***E21B 10/52*** | (2006.01) |

(52) U.S. Cl.
CPC ..... *E21B 10/52* (2013.01); *E21B 10/55* (2013.01); *E21B 10/567* (2013.01); *E21B 10/5673* (2013.01)

(56) References Cited

U.S. PATENT DOCUMENTS 6,042,463 A * 3/2000 Johnson ..... E21B 10/5735 451/540
6,499,547 B2 * 12/2002 Scott ..... B22F 7/06 175/374
8,695,733 B2 * 4/2014 Fang ..... B22F 7/08 175/420.2
2011/0031032 A1 2/2011 Mourik et al.
2011/0042147 A1 2/2011 Fang et al.
2011/0061944 A1 * 3/2011 Scott ..... B01J 3/062 175/428
2012/0261197 A1 10/2012 Miess et al.

OTHER PUBLICATIONS

Supplementary Search Report issued in European Patent Application 14859706.5 dated Sep. 14, 2016. 3 pages.
Examination Report 94(3) EPC issued in European Patent Application 14859706.5 dated Oct. 28, 2016. 10 pages.
International Search Report and Written Opinion issued in PCT/US2014/064455 dated Feb. 17, 2015, 15 pages.

* cited by examiner

POLYCRYSTALLINE DIAMOND CUTTING ELEMENTS WITH TRANSITION ZONES AND DOWNHOLE CUTTING TOOLS INCORPORATING THE SAME

CROSS REFERENCE TO RELATED APPLICATION

This Application claims the benefit to and priority of U.S. Provisional Application 61/901,910 filed on Nov. 8, 2013, the entirety of which is incorporated herein by reference.

BACKGROUND

Polycrystalline diamond (PCD) materials known in the art are formed from diamond grains or crystals and a ductile metal binder and are synthesized by high temperature/high pressure processes. Such material is well known for its mechanical properties of wear resistance, making it a popular material choice for use in such industrial applications as cutting tools for machining, and subterranean mining and drilling where such mechanical properties are highly desired. For example, conventional PCD can be provided in the form of surface coatings on, e.g., cutting elements used with cutting and drilling tools to impart improved wear resistance thereto.

Generally, PCD-containing cutting elements used in such applications are formed by coating a carbide substrate with a layer of PCD. Such cutting elements include a substrate, a surface layer, and often a transition layer to improve the bonding between the exposed layer and the substrate. The substrate is generally a carbide material, e.g., cemented carbide, tungsten carbide (WC) cemented with cobalt (WC—Co).

The PCD layer generally includes metal binder up to about 30 percent by weight. The metal binder facilitates diamond intercrystalline bonding, and bonding of diamond layer to the substrate. Metals employed as the binder are often selected from cobalt, iron, or nickel and/or mixtures or alloys thereof and may include metals such as manganese, tantalum, chromium and/or mixtures or alloys thereof. However, while higher metal binder content generally increases the toughness of the resulting PCD material, higher metal content also decreases the PCD material hardness and wear resistance, thus limiting the flexibility of being able to provide PCD coatings having desired levels of hardness, wear resistance and toughness. Additionally, when variables are selected to increase the hardness or wear resistance of the PCD material, generally brittleness also increases, thereby reducing the toughness of the PCD material.

Conventional PCD cutting elements may optionally include one or more transition layers between the PCD layer and the substrate. Such transition layers may include refractory particles such as carbides in addition to the diamond and metal binder to change material properties through the layers. However, carbide content manipulation does not necessarily promote the best transition between adjacent PCD layers, permitting discrete interfaces to exist between the layers which can promote unwanted stress concentrations. The existence of these discrete interfaces, and the resulting stress concentrations produced therefrom, can cause premature failure of the PCD cutting element by delamination along the layer-to-layer interfaces.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cutting element that includes a substrate including a plurality of metal carbide particles and a first metal binder having a first metal binder content; an outer layer of polycrystalline diamond material at an end of the cutting element, the polycrystalline diamond material including: a plurality of interconnected diamond particles; and a plurality of interstitial regions disposed among the interconnected diamond particles, the plurality of interstitial regions contain a second metal binder having a second metal binder content; and at least one transition zone between the substrate and the outer layer, the at least one transition zone comprising a plurality of refractory metal carbide particles and a third metal binder having a third metal binder content, the third metal binder content being less than the first metal binder content and the second metal binder content.

In another aspect, embodiments disclosed herein relate to a method of forming a cutting element that includes placing a volume of diamond grains adjacent one or more transition volumes of a mixture of refractory metal particles and a carbon source, the one or more transition volumes comprising a first transition volume having at least 60 wt % refractory metal particles based on the total weight of the first transition volume; placing a metal carbide substrate material comprising a plurality of carbide particles and a metal binder adjacent the one or more transition volumes, opposite the volume of diamond grains; and subjecting the volume of diamond grains, one or more transition volumes, and the metal carbide substrate material to high pressure/high temperature sintering conditions to form a sintered polycrystalline diamond body attached to a substrate with at least one transition zone therebetween.

In yet another aspect, embodiments disclosed herein relate to a downhole cutting tool that includes a tool body and at least one cutting element fixed to the tool body, the cutting element including a substrate including a plurality of metal carbide particles and a first metal binder having a first metal binder content; an outer layer of polycrystalline diamond material at an end of the cutting element, the polycrystalline diamond material including: a plurality of interconnected diamond particles; and a plurality of interstitial regions disposed among the interconnected diamond particles, the plurality of interstitial regions contain a second metal binder having a second metal binder content; and at least one transition zone between the substrate and the outer layer, the at least one transition zone comprising a plurality of refractory metal carbide particles and a third metal binder having a third metal binder content, the third metal binder content being less than the first metal binder content and the second metal binder content.

Other aspects and advantages of the claimed subject matter will be apparent from the following description and the appended claims.

DETAILED DESCRIPTION

In one aspect, embodiments disclosed herein relate to use of transition zones (or transition layers) in polycrystalline diamond (PCD) cutting elements. Specifically, one or more embodiments disclosed herein relate to the formation of carbide particles in situ in the one or more transition zones, and the specific composition that may be used to form such carbide particles in a desirable manner. In one or more embodiments, the present disclosure also relates to a non-uniform metal content throughout the cutting element, and specifically in one or more transition zones, as compared to the polycrystalline diamond outer layer and/or carbide substrate. Methods for manufacturing a PCD cutting element that includes at least one transition zone between the PCD layer and the substrate and embodiments utilizing the disclosed cutting elements in various articles and apparatuses, such as rotary drill bits, mining and construction tools, bearing apparatuses, wire-drawing dies, machining equipment, and other articles and apparatuses are also disclosed.

As used herein, "polycrystalline diamond", along with its abbreviation, "PCD", or "a polycrystalline diamond material" refers to the three-dimensional network or lattice of bonded together or interconnected diamond grains. Specifically, the diamond to diamond bonding is catalyzed by a metal (such as cobalt) by a high temperature/high pressure process, whereby the metal remains in the regions between the particles. Thus, the metal particles added to the diamond particles may function as a catalyst and/or binder, depending on the exposure to diamond particles that can be catalyzed as well as the temperature/pressure conditions. For the purposes of this application, when a metallic component is referred to as a metal binder, it does not necessarily mean that no catalyzing function is also being performed, and when the metallic component is referred to as a metal catalyst, it does not necessarily mean that no binding function is also being performed.

Figure 1:
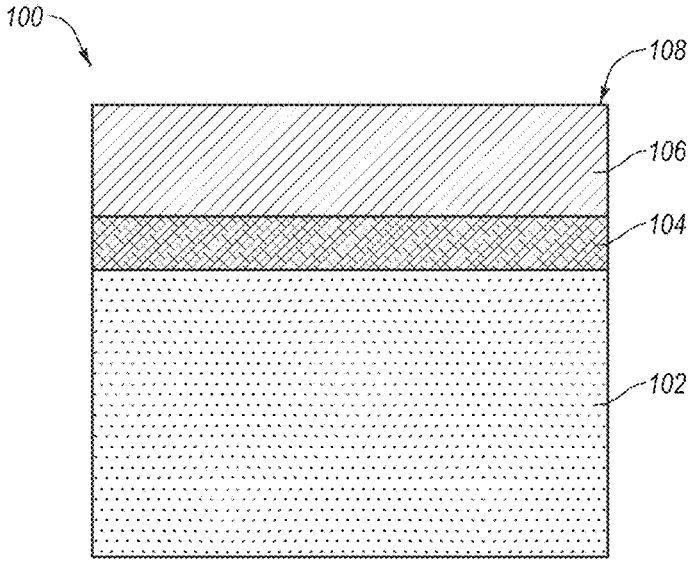
FIG. 1 is a cutting element according to one or more embodiments.

Referring to FIG. 1, an embodiment of a PCD cutting element 100 includes at least one PCD layer 106, a substrate 102, and at least one transition zone 104 disposed between the substrate 102 and the PCD layer 106. As illustrated, the PCD layer 106 exhibits a planar upper surface 108. Although FIG. 1 shows the upper surface 108 as being planar, the upper surface 108 may be concave, convex, or another non-planar geometry. The substrate 102 may be generally cylindrical or another selected configuration, without limitation. The substrate 102 may include, without limitation, cemented carbides, such as tungsten carbide, titanium carbide, chromium carbide, niobium carbide, tantalum carbide, vanadium carbide, or combinations thereof cemented with iron, nickel, cobalt, or alloys thereof. For example, in an embodiment, the substrate 102 includes cobalt-cemented tungsten carbide.

Figure 2:
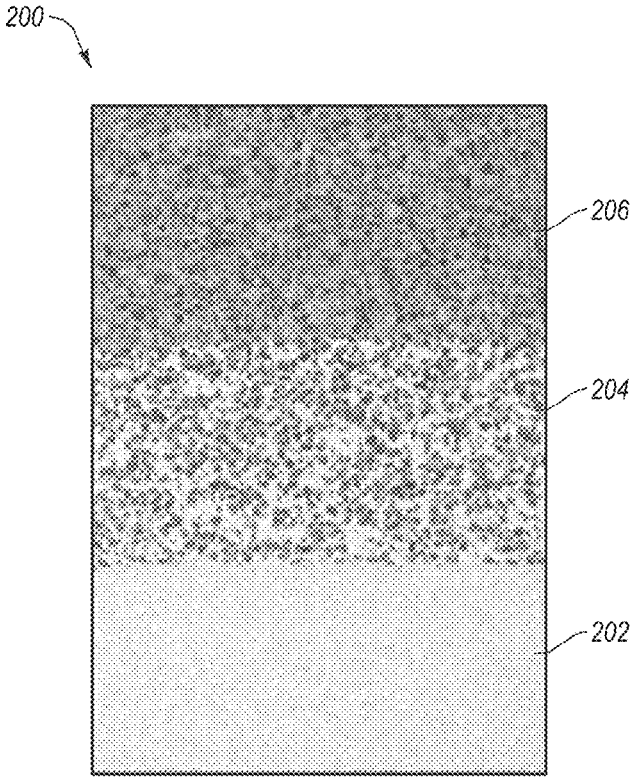
FIG. 2 is an SEM image of an embodiment of a microstructure with one transition zone.

FIG. 2 shows an SEM image of a portion of a PCD cutting element microstructure according to one or more embodiments. As shown in FIG. 2, microstructure 200 of cutting element (not shown) includes three microstructure regions: polycrystalline diamond region 206, substrate region 202, and a transition zone or region 204 therebetween. Polycrystalline diamond region 206 includes a plurality of interconnected diamond particles (i.e., having diamond-to-diamond bonds) having interstitial regions or pockets therebetween. Interstitial regions include a metal binder component therein, and optionally may include a refractory metal content (present either in metal form or in a refractory metal carbide form). Transition zone 204 may include a plurality of refractory metal carbide particles dispersed in a metal binder phase, and optionally may include a plurality of diamond grains. Substrate 202 may include a plurality of metal carbide particles cemented together with a metal binder. The metal binder used in each of the polycrystalline diamond region 206, the transition zone 204, and the substrate region 202 may include a Group VIII metal, such as cobalt, iron, or nickel that infiltrates from the substrate 202 through the transition zone 204 and into the polycrystalline diamond region 206 during HPHT sintering. In one or more embodiments, the transition zone 204 has a metal binder content less than the polycrystalline diamond region 206 and/or the substrate region 202.

Figure 3:
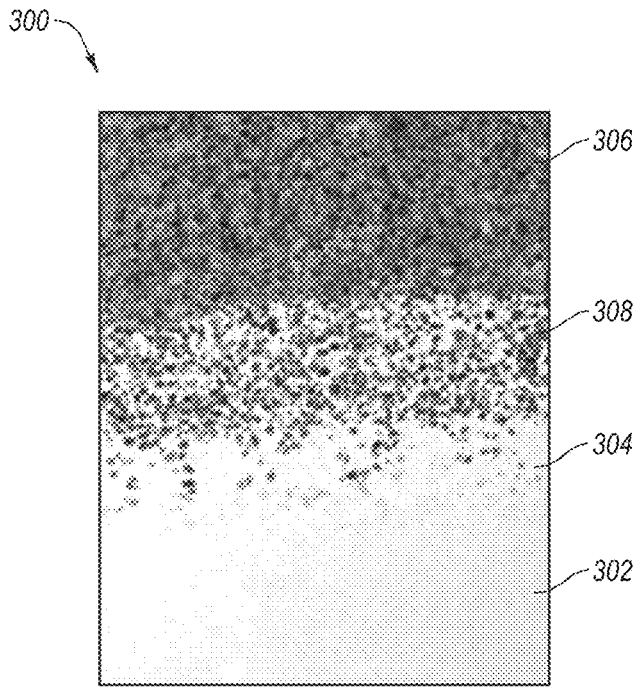
FIG. 3 is an SEM image of an embodiment of a microstructure with two transition zones.

FIG. 3 shows an SEM image of a portion of a PCD cutting element microstructure according to one or more embodiments. As shown in FIG. 3, microstructure 300 of cutting element (not shown) includes four microstructure regions: polycrystalline diamond region 306, substrate region 302, and two transition zones or regions 304, 308 between the polycrystalline diamond region 306 and substrate region 302. Polycrystalline diamond region 306 includes a plurality of interconnected diamond particles (i.e., having diamond-to-diamond bonds) having interstitial regions or pockets therebetween. Interstitial regions include a metal binder component therein, and optionally may include a refractory metal content (present either in metal form or in a refractory metal carbide form). Transition zone 304 may include a plurality of refractory metal carbide particles dispersed in a metal binder phase, and optionally may include a plurality of diamond grains. Transition zone 308, like transition zone 304, may include a plurality of diamond grains and plurality of refractory metal carbide particles dispersed in a metal binder phase. Transition zone 308, being closer to polycrystalline diamond region 306, may include a greater diamond content than transition zone 304. Substrate 302 may include a plurality of metal carbide particles cemented together with a metal binder. The metal binder used in each of the polycrystalline diamond region 306, the transition zones 304, 308, and the substrate region 302 may include a Group VIII metal, such as cobalt, iron, or nickel that infiltrates from the substrate 302 through the transition zones 304, 308 and into the polycrystalline diamond region 306 during HPHT sintering. In one or more embodiments, the transition zone 304 has a metal binder content less than the polycrystalline diamond region 306 and/or the substrate region 302. In one or more other embodiments, transition zone 308 has a metal binder content less than the polycrystalline diamond region 306 and/or the substrate region 302. Further, in some embodiments, both transition zones 304 and 308 have metal binder contents less than the polycrystalline diamond region 306 and/or the substrate region 302.

The above described transition zones include a plurality of refractory metal carbide particles. In one or more embodiments, such refractory metal carbide particles are not incorporated into the cutting element in a preexisting state, rather, the refractory metal carbide particles are formed in situ, by reaction of a refractory metal with carbon existing in the zone along with the refractory metal (present in the form of diamond particles, graphite particles, carbon black, carbon-containing wax, or other carbon sources, for example) at HPHT sintering conditions. That is, when an assembly of an unsintered mixture of diamond particles (or other carbon sources) and refractory metal is subjected to high pressure/high temperature conditions, the refractory metal and carbon may react in situ to form refractory metal carbide particles. Such reaction may be accompanied by grain growth of the refractory metal particles as the refractory metal forms refractory metal carbide. Such growth observed may include an initial refractory metal particle size of less than 5 microns, less than 3 microns, less than 2 microns, less than 1 micron or even less than 0.5 microns, resulting in a refractory metal carbide particle size of at least 5 microns, at least 6 microns, or at least 8 microns. In one or more embodiments, the refractory metal carbide particles may be less than 10 microns. However, to some extent, the final refractory metal carbide particle size may depend, in part, on the size of the initial refractory metal particles. Thus, when nanopowders are used, the final refractory metal carbide particles may have a greater particle size than the nanopowders, but still less than 5 microns, such as for example, at least 2 microns.

In various embodiments, the refractory metal particles may be any metal-carbide forming metal, such as W, Ta, Ti, Nb, Zr, mixtures thereof, etc.; however, particular embodiments may use tungsten metal. Further, depending on the type of carbon source being used, it is also within the scope of the present disclosure that the refractory metal may be coated with the carbon source, such as a carbon-containing polymer coating, such as polyethylene glycol or methoxy-polyethylene glycol. In one or more other embodiments, a carbon-containing polymer coating may be substantially free of oxygen or other impurities may be used to coat refractory metal particles for use in forming the one or more transition layers (or outer layer, when included).

As mentioned above, the metal binder infiltrates from the substrate through the one or more transition zones and into the polycrystalline diamond layer. While metal binder may generally be provided to a mixture of diamond particles (to catalyze the formation of diamond to diamond bonds, to form polycrystalline diamond) from the substrate or included with a diamond mixture, one or more embodiments of the present disclosure only use metal binder that is provided from the substrate to infiltrate through the cutting element. Thus, the cup (e.g., sintering container or can), which is placed into a reaction cell and subjected to an HPHT process may include (1) a first volume of a mixture of diamond particles (free of a catalyzing metal binder and, optionally, consisting of diamond particles or consisting of diamond particles and non-catalyzing refractory metal), (2) an adjacent, second volume of a mixture of diamond particles with a refractory metal (free of a catalyzing metal binder and, optionally, consisting of diamond particles and non-catalyzing refractory metal), and (3) a preformed substrate or green substrate material of carbide particles and a (catalyzing) metal binder. Thus, when the assembled of volumes and substrate material is subjected to HPHT sintering conditions, the metal binder may infiltrate through the second volume to the first volume, thereby catalyzing the formation of the polycrystalline diamond microstructure. The inventors of the present application also theorize that by using an infiltrated metal binder (instead of a metal binder provided with the first or second volume), the infiltrating metal is at least partially saturated with carbon therein, and thus, when the infiltrating metal infiltrates through the second volume, such at least partial saturation further shifts the reaction equilibrium between the refractory metal and the carbon (present in diamond particles) towards formation of refractory metal carbides. Further, as the refractory metal carbide particles grow, the grain growth may physically push the infiltrating binder into one of the adjacent layers, such as the polycrystalline diamond layer and/or substrate, resulting in the non-uniform metal binder content throughout the cutting element, described above. For embodiments using more than one transition zone, one skilled in the art would appreciate that a third or fourth volume, etc., of diamond particles mixed with refractory metal particles (at differing ratios) may be provided in the assembly and subjected to HPHT sintering conditions. Further, one or more of the transition zones may have a higher hardness as well as higher strength and toughness than the substrate, which the present inventors believe results from the in situ formation of a refractory metal carbide and non-uniform metal binder content present in the one or more transition zones.

Further, in one or more embodiments, the amount of diamond incorporated into the second volume may be selected to optimize or increase refractory metal carbide formation. For example, if the refractory metal being used is tungsten, then atomic mass of both tungsten and carbon can be considered to ensure a greater conversion of refractory metal and diamond (or other carbon sources) to refractory metal carbide. Likewise, if lighter titanium is used, then the desired weight percent of titanium would likely shift downward. In one or more embodiments, a second volume may be provided with at least 60 wt % refractory metal, and a balance of diamond particles, or with at least 70, 80, or 85 wt % refractory metal in one or more other embodiments (and a balance diamond). Depending on the relative amount of diamond and refractory metal used, the amount of diamond particles remaining in the at least one transition layer may accordingly vary. For example, in the case of tungsten, where a 1:1 reaction of tungsten (having an atomic mass of 183.84 u) and carbon (having an atomic mass of 12.0107 u) results in a mass percent of 93.867% tungsten and 6.13% carbon, if 10 wt % of diamond were incorporated in the second volume, assuming the tungsten fully reacts with diamond, there may be less than 5 wt % of diamond remaining in the formed transition zone. In one or more embodiments, it may be particularly desirable to provide a second volume having diamond particles such that no more than 5 wt % of diamond particles would remain after reaction with the refractory metal, assuming full conversion of the refractory metal (and a 1:1 reaction). While theoretical 1:1 reactions are described, it is within the scope of the present disclosure that other carbides may be formed, such as $W_2C$ as well as complex carbides. However, depending on the number of transition zones to be incorporated into the cutting element, the appropriate diamond content (and thus, diamond content remaining after HPHT sintering) may be selected.

For example, in one or more embodiments, at least one transition zone includes a diamond content of less than 5 wt %, a refractory metal carbide content of up to 95 wt %, and a metal binder content of ranging from about 1 to 8 wt % (or 1 to 2 wt % in particular embodiments). However, as mentioned above, when two or more transition zones are included in a cutting element, the zone adjacent the PCD layer may have a diamond content that may be greater than 10 wt % (or ranging from 20-60 wt % in a particular embodiment), the refractory metal carbide content may be less than 90 wt % (or ranging from 40-80 wt % in particular embodiments), and the metal binder content of at least one transition zone may be 1 to 8 wt %. In one or more embodiments, such transition zone having such greater diamond content may be used in combination with a zone adjacent the substrate having a diamond content of less than 5 wt %, a refractory metal carbide content of up to 95 wt %, and a metal binder content of ranging from about 1 to 8 wt %. Further, when two or more transition zones are present, at least one of the transition zones may have a metal binder content that is less than the metal binder content of the outer PCD layer and the substrate. In some embodiments, two or more transition zones may have the reduced metal binder content, but in other embodiments, one of the transition zones may have the reduced metal binder content, and another of the transition zones may have a binder content that is similar to the outer PCD layer and substrate.

As mentioned above, in one or more embodiments, the polycrystalline diamond outer layer may include a plurality of diamond particles, a metal binder residing in the interstitial spaces between the plurality of diamond particles, and optionally, a refractory metal also residing within the interstitial spaces. In such embodiments, the polycrystalline diamond material may include a diamond content of up to 94 wt %, a second metal binder content of at least 6 wt %, and a refractory metal content of up to 5 wt %.

The substrate may be formed from a suitable material such as tungsten carbide, tantalum carbide, or titanium carbide. In the substrate, metal carbide grains are supported by a matrix of a metal binder. Thus, various binding metals may be present in the substrate, such as cobalt, nickel, iron, alloys thereof, or mixtures, thereof. In a particular embodiment, the substrate may be formed of a sintered tungsten carbide composite structure of tungsten carbide and cobalt. However, it is known that various metal carbide compositions and binders may be used in addition to tungsten carbide and cobalt. Thus, references to the use of tungsten carbide and cobalt are for illustrative purposes, and no limitation on the type of carbide or binder use is intended. In one or more embodiments, the substrate may include a metal carbide content of at least 85 wt %, and a metal binder content of at least 6 wt %. Such cemented carbides may include those described for example as 406, 313/314, 614, etc., as well as other carbide blends having the described metal content (and a particle size that balances the desired metal content).

As mentioned above, the cutting elements of the present disclosure may be formed by sintering the precursor materials to HPHT sintering conditions. Specifically, a polycrystalline diamond material may be formed by placing an unsintered mass of diamond crystalline particles within a metal enclosure of a reaction cell of a HPHT apparatus and subjecting individual diamond crystals to sufficiently high pressure and high temperatures (sintering under HPHT conditions) that intercrystalline bonding occurs between adjacent diamond crystals. A metal catalyst, such as cobalt or other Group VIII metals, may be provided to the unsintered mass of crystalline particles to promote intercrystalline diamond-to-diamond bonding by infiltration from the substrate (or substrate material) into the diamond grains during HPHT sintering.

The reaction cell is then placed under processing conditions sufficient to cause the intercrystalline bonding between the diamond particles. It should be noted that if too much additional non-diamond material, such as tungsten carbide or cobalt is present in the powdered mass of crystalline particles, appreciable intercrystalline bonding is prevented during the sintering process. Such a sintered material where appreciable intercrystalline bonding has not occurred is not within the definition of PCD.

The transition layers may similarly be formed by placing an unsintered second volume of diamond particles and refractory metal within the HPHT apparatus, adjacent the unsintered mass of diamond particles forming the polycrystalline diamond layer. The reaction cell is then placed under processing conditions sufficient to cause sintering of the material to create the transition zone. Additionally, a preformed metal carbide substrate precursor substrate materials may be included adjacent the second volume, opposite from the first volume forming the polycrystalline diamond layer. During the HPHT sintering conditions, the polycrystalline diamond layer is formed, as well as joined to the substrate through the transition zone(s).

In one or more embodiments, a minimum temperature is about 1200° C., and a minimum pressure is about 35 kilobars. In specific embodiments, processing may be at a pressure of about 45-90 kilobars and a temperature of about 1300-2000° C. The minimum sufficient temperature and pressure in a given embodiment may depend on other parameters such as the presence of a catalytic material, such as cobalt. Generally, the diamond crystals will be subjected to the HPHT sintering in the presence of a diamond catalyst material, such as cobalt, to form an integral, tough, high strength mass or lattice. The catalyst, e.g., cobalt, may be used to promote recrystallization of the diamond particles and formation of the lattice structure, and thus, cobalt particles are generally found within the interstitial spaces in the diamond lattice structure. Those of ordinary skill will appreciate that a variety of temperatures and pressures may be used, and the scope of the present disclosure is not limited to specifically referenced temperatures and pressures.

Application of the HPHT processing will cause diamond crystals to sinter and form a polycrystalline diamond layer. Similarly, application of HPHT to the second volume will cause the diamond crystals and refractory metal particles to react, forming refractory metal carbide particles that are sintered together by the metal binder infiltrating through from the substrate such that the refractory metal carbide particles are no longer in the form of discrete particles that can be separated from each other. Further, each of the layers bond to each other and to the substrate during the HPHT process.

It is also within the scope of the present disclosure that the polycrystalline diamond outer layer may have at least a portion of the metal catalyst removed therefrom, such as by leaching the diamond layer with a leaching agent (often a strong acid). In a particular embodiment, at least a portion of the diamond layer may be leached in order to gain thermal stability without losing impact resistance.

The variations in the particle sizes of the refractory metal and resulting refractory metal carbide particle due to grain growth were discussed above. In addition to controlling the refractory metal particle size, the particle size of the diamond particles used in the first volume (as well as the second (or third, etc) volume(s)) may also be controlled. Generally, a particle size ranging from about 0.5 to 100 microns (or 4 to 30 microns in particular embodiments) may be used; however, it is also within the scope of the present disclosure that smaller particle sizes may be used, including in the nanorange, such as for mixture in the second volume, used to form a transition zone. Within the 4-30 micron range, certain types of cutting elements may have particularly desirable sub-ranges. For example, for an insert (illustrated in FIG. 4) used in roller cone (illustrated in FIG. 11) and/or hammer bits (illustrated in FIG. 12), a diamond particle size ranging from about 4 to 8 microns may be used. For a shear cutter (illustrated in FIG. 1) used in drag bits (such as a PDC fixed cutter bit illustrated in FIG. 13), a diamond particle size that is at least about 10 microns may be used. Finally, for a substantially pointed cutting element (illustrated in FIGS. 5-11) used in drag bits (illustrated in FIG. 13), for example, a diamond particle size ranging from about 10 to 30 microns may be used.

Figure 4:
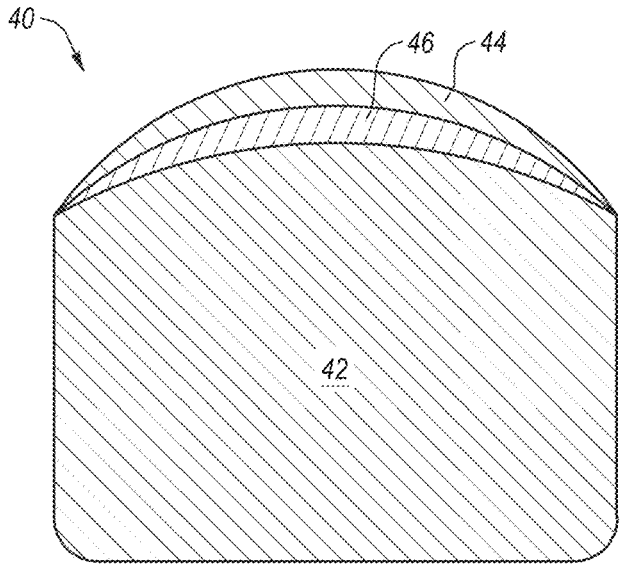
FIG. 4 shows an insert of the present disclosure for use in roller cone bits and/or hammer bits.

Referring now to FIG. 4, insert 40 includes a polycrystalline diamond outer layer 44, a substrate 42, and a transition zone 46 therebetween. As illustrated, the upper surface of the polycrystalline diamond outer layer 44 is generally convex, commonly referred to as a dome shape.

Figure 7:
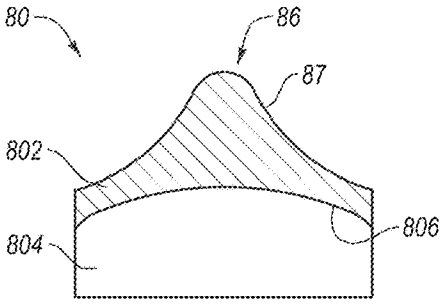
FIG. 7 shows a cutting element having concave side surfaces terminating in a rounded apex.
Figure 6:
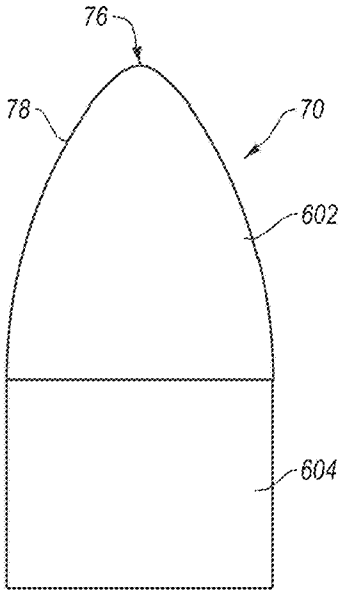
FIG. 6. shows a cutting element having a bullet shaped cutting element.
Figure 5:
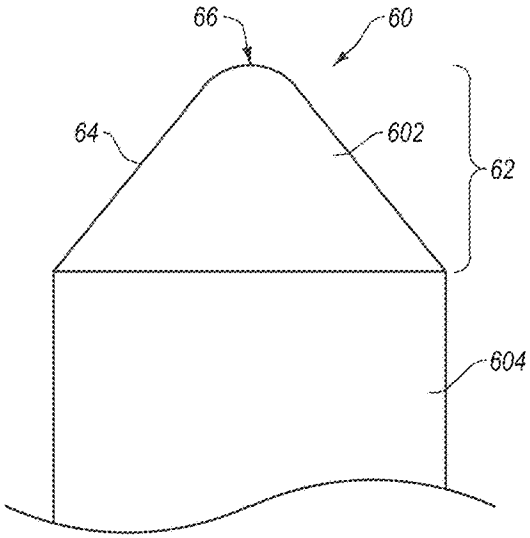
FIG. 5 shows a cutting element having a conical cutting element according to one or more embodiments.

Referring now to FIGS. 5-7, various embodiments of cutting elements with a generally pointed cutting end and terminating in a rounded apex is shown. As shown in FIG. 5, cutting elements may have a generally conical cutting end 62 (including either right cones or oblique cones), i.e., a conical side wall 64 that terminates in a rounded apex 66. Unlike geometric cones that terminate at a sharp point apex, the conical cutting elements of the present disclosure possess an apex having curvature between the side surfaces and the apex. Further, in one or more embodiments, a bullet cutting element 70 may be used, as illustrated in FIG. 6. The term "bullet cutting element" refers to cutting element having, instead of a generally conical side surface, a generally convex side surface 78 terminated in a rounded apex 76, the overall shape of which may also be referred to as an ogive. In one or more embodiments, the apex 76 has a substantially smaller radius of curvature than the convex side surface 78. However, it is also intended that the non-planar cutting elements of the present disclosure may also include other shapes, including, for example, a concave side surface terminating in a rounded apex, shown in FIG. 7. In each of such embodiments, the non-planar cutting elements may have a smooth transition between the side surface and the rounded apex (i.e., the side surface or side wall tangentially joins the curvature of the apex), but in some embodiments, a non-smooth transition may be present (i.e., the tangent of the side surface intersects the tangent of the apex at a non-180 degree angle, such as for example ranging from about 120 to less than 180 degrees). Further, in one or more embodiments, the non-planar cutting elements may include any shape having an cutting end extending above a grip or base region, where the cutting end extends a height that is at least 0.25 times the diameter of the cutting element, or at least 0.3, 0.4, 0.5 or 0.6 times the diameter in one or more other embodiments.

Referring back to FIGS. 5-7, variations of non-planar cutting elements that may be in any of the embodiments disclosed herein are shown. The non-planar cutting elements provided on a drill bit or reamer (or other cutting tool of the present disclosure) possess a diamond layer 602, 702, 802 on a substrate 604, 704, 804 (such as a cemented tungsten carbide substrate), where the diamond layer 602, 702, 802 forms the non-planar diamond working surface. While not illustrated in these figures, the cutting elements may include one or more transition zones between the polycrystalline diamond outer layer 602, 702, 802, and substrate 604, 704, 804. The interface (not shown in FIGS. 5 and 6 and illustrated as 806 in FIG. 7) between diamond layer 602, 702, 802 and substrate 604, 704, 804 may be non-planar or non-uniform, for example, to aid in reducing incidents of delamination of the diamond layer 602, 702, 802 from substrate 604, 704, 804 when in operation and to improve the strength and impact resistance of the element. One skilled in the art would appreciate that the interface may include one or more convex or concave portions, as known in the art of non-planar interfaces. Additionally, one skilled in the art would appreciate that use of some non-planar interfaces may allow for greater thickness in the diamond layer in the tip region of the layer. Further, it may be desirable to create the interface geometry such that the diamond layer is thickest at a zone that encompasses the primary contact zone between the diamond enhanced element and the formation. In one or more embodiments, the diamond layer 602, 702, 802 (including the one or more transition zones) may have a thickness of 1.25 to 6.5 millimeters from the apex to the central region of the substrate, and in or more particular embodiments, such thickness may range from 3 to 5 millimeters. The diamond layer 602, 702, 802 and the cemented metal carbide substrate 604, 704, 804 may have a total thickness of 5 to 18 millimeters from the apex to a base of the cemented metal carbide substrate. However, other sizes and thicknesses may also be used. Further, it is also specifically within the scope of the present disclosure that the apex 66, 76, 86 has a radius of curvature ranging from about 1.25 to 4 millimeters, and from 1.25 to 3 millimeters in yet another embodiment. While not illustrated specifically in FIGS. 5-7, in some embodiments, the at least one transition zone has a thickness, at its thickest point, ranging from about 0.25 to 2.5 millimeters, and from 0.4 to 0.7 millimeters in particular embodiments.

Figure 8:
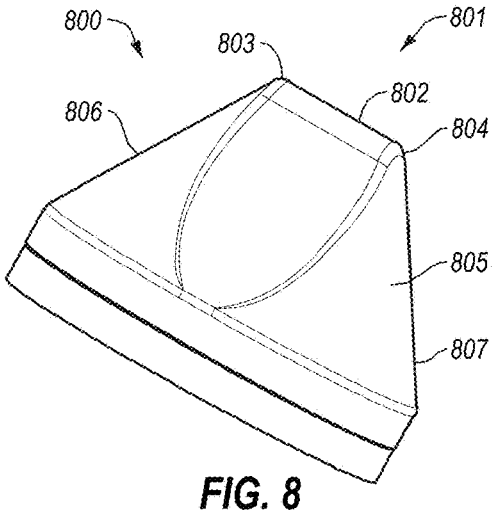
FIGS. 8 and 9 show a cutting element having a linearly extending apex.
Figure 9:
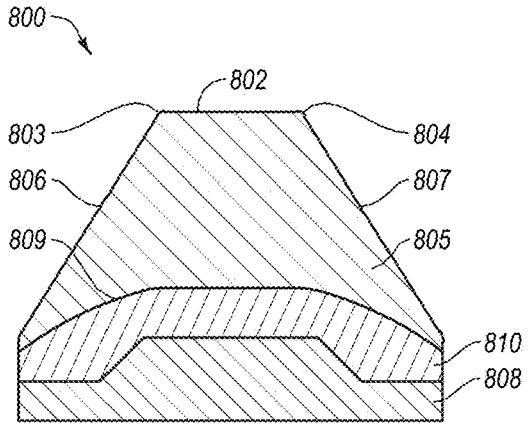
Figure 10:
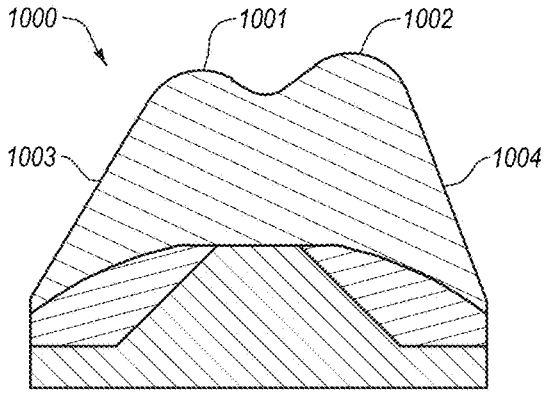
FIG. 10 shows a cutting element having multiple apexes.

Further, while FIGS. 5-7 each include a point-apex, it is also within the scope of the present disclosure that the rounded apex may be linearly extending, as illustrated, for example in FIGS. 8-9, or that there may be more than one apex, as illustrated in FIG. 10. The radius of curvature ranges mentioned above also apply to such embodiments, where the linearly extending apex may have a radius of curvature of the disclosed range from a cross-sectional view that is perpendicular to the linear extending apex. Further, in the case of two apices, one or more both apices may have the disclosed radius of curvature.

For example, referring to FIGS. 8-9, cutting element 800 is illustrated. In this embodiment, an apex 801 includes a linear portion 802 and two curved areas 803 and 804. A diamond body portion 805 includes a leading side 806 and a trailing side 807. Curved areas 803 and 804 join the linear portion 802 to the leading side 806 and trailing side 807. Curved areas 803 and 804 tangentially join linear portion 802 to leading side 806 and trailing side 807. A cemented metal carbide substrate 808 joins diamond body portion 805 at a non-planer interface 309 with a transition zone 810 therebetween.

Referring now to FIG. 10, a cutting element 1000 having multiple apexes is shown. Cutting element 1000 includes conical geometry and two apexes 601 and 602, with a leading side 603 and a trailing side 604 tangentially joined to apexes 601 and 602. Apexes 601 and 602 may have equal or unequal radii of curvature.

The polycrystalline diamond outer layer may have a thickness of at least 0.006 inches in one embodiment, and at least 0.020 inches or 0.040 inches in other embodiments. As used herein, the thickness of any polycrystalline diamond layer refers to the maximum thickness of that layer, as the diamond layer may vary in thickness across the layer. Specifically, it is within the scope of the present disclosure that the thickness of a polycrystalline diamond layer may vary so that the thickness is greatest within the zone of the cutting element that engages the formation. It is expressly within the scope of the present disclosure that a polycrystalline diamond layer may vary or taper such that it has a non-uniform thickness across the layer. Such variance in thickness may generally result from the use of non-uniform upper surfaces of the insert body/substrate in creating a non-uniform interface. In one or more particular embodiments, a non-uniform interface may be used that includes a dome or generally convex interface, particularly when used in combination with the substantially pointed cutting elements illustrated in FIGS. 5-10. However, it is also within the scope of the present disclosure that other interface geometries, as well as a planar interface may also be used.

Figure 11:
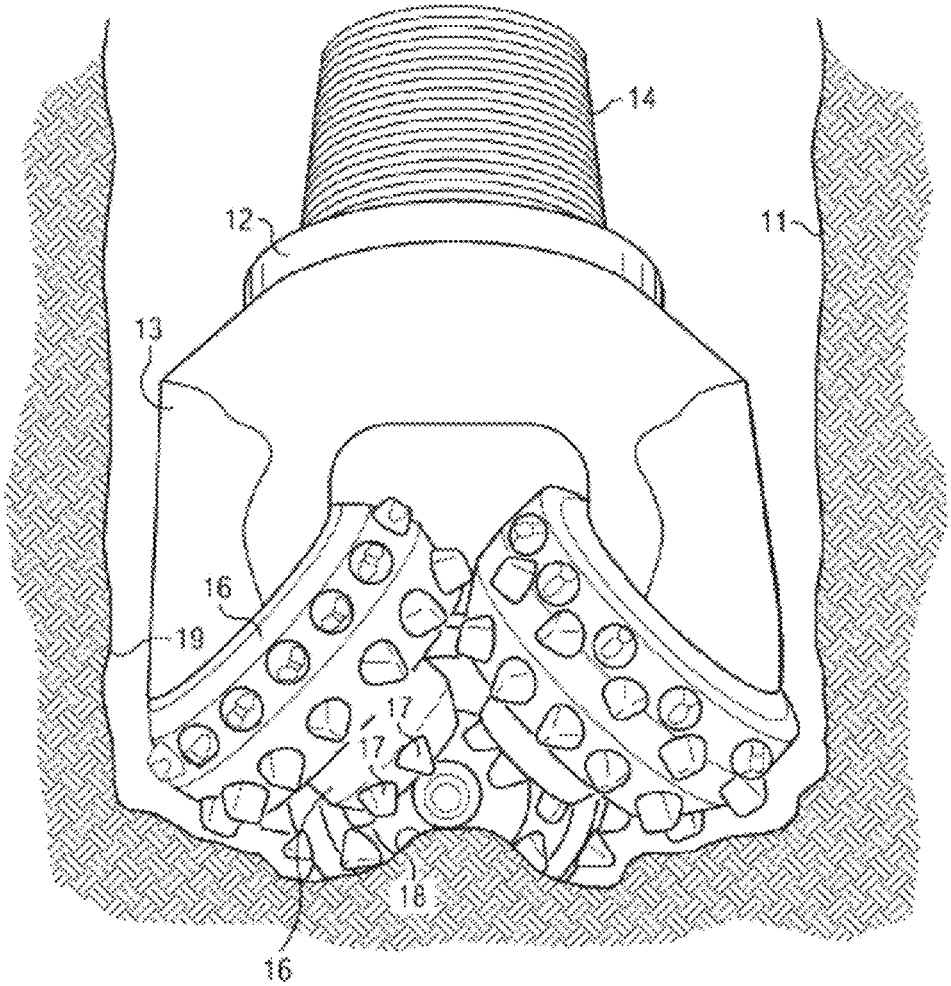
FIG. 11 shows a roller cone drill bit.

The cutting elements of the present disclosure may find particular use in roller cone bits and hammer bits. Roller cone rock bits include a bit body adapted to be coupled to a rotatable drill string and include at least one "cone" that is rotatably mounted to the bit body. Referring to FIG. 11, a roller cone rock bit 10 is shown disposed in a borehole 11. The bit 10 has a body 12 with legs 13 extending generally downward, and a threaded pin end 14 opposite thereto for attachment to a drill string (not shown). Journal shafts (not shown) are cantilevered from legs 13. Roller cones (or rolling cutters) 16 are rotatably mounted on journal shafts. Each roller cone 16 has a plurality of cutting elements 17 mounted thereon. As the body 10 is rotated by rotation of the drill string (not shown), the roller cones 16 rotate over the borehole bottom 18 and maintain the gage of the borehole by rotating against a portion of the borehole sidewall 19. As the roller cone 16 rotates, individual cutting elements 17 are rotated into contact with the formation and then out of contact with the formation.

Figure 12:
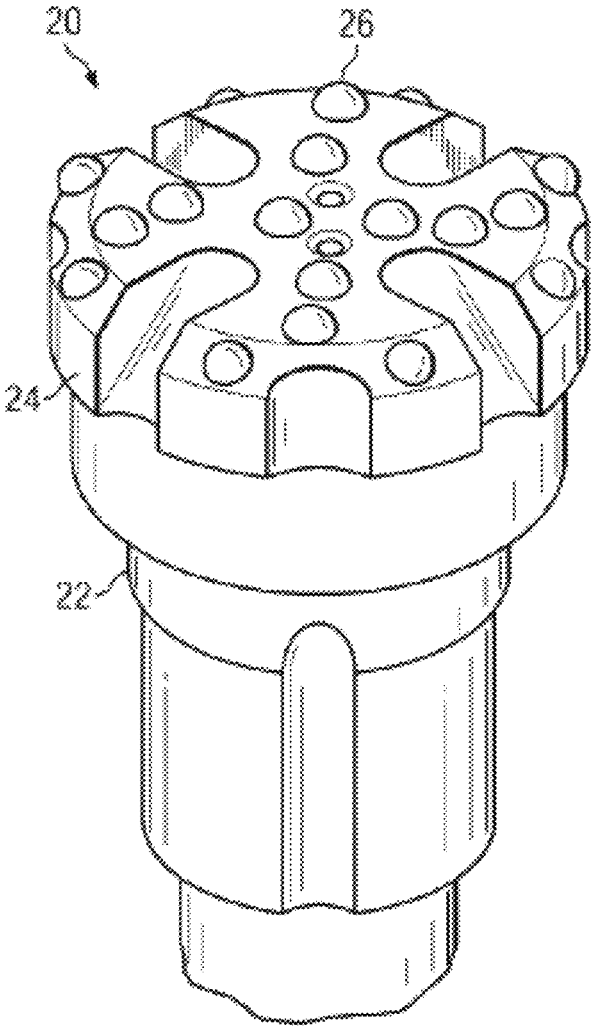
FIG. 12 shows a hammer bit.

Hammer bits generally are impacted by a percussion hammer while being rotated against the earth formation being drilled. Referring to FIG. 12, a hammer bit is shown. The hammer bit 20 has a body 22 with a head 24 at one end thereof. The body 22 is received in a hammer (not shown), and the hammer moves the head 24 against the formation to fracture the formation. Cutting elements 26 are mounted in the head 24. Generally, the cutting elements 26 are embedded in the drill bit by press fitting or brazing into the bit.

The cutting inserts of the present disclosure may have a body having a cylindrical grip portion from which a convex protrusion extends. The grip is embedded in and affixed to the roller cone or hammer bit, and the protrusion extends outwardly from the surface of the roller cone or hammer bit. The protrusion, for example, may be hemispherical, which is commonly referred to as a semi-round top (SRT), or may be conical, or chisel-shaped, or may form a ridge that is inclined relative to the plane of intersection between the grip and the protrusion. In some embodiments, the polycrystalline diamond outer layer and one or more transition layers may extend beyond the convex protrusion and may coat the cylindrical grip.

Figure 13:
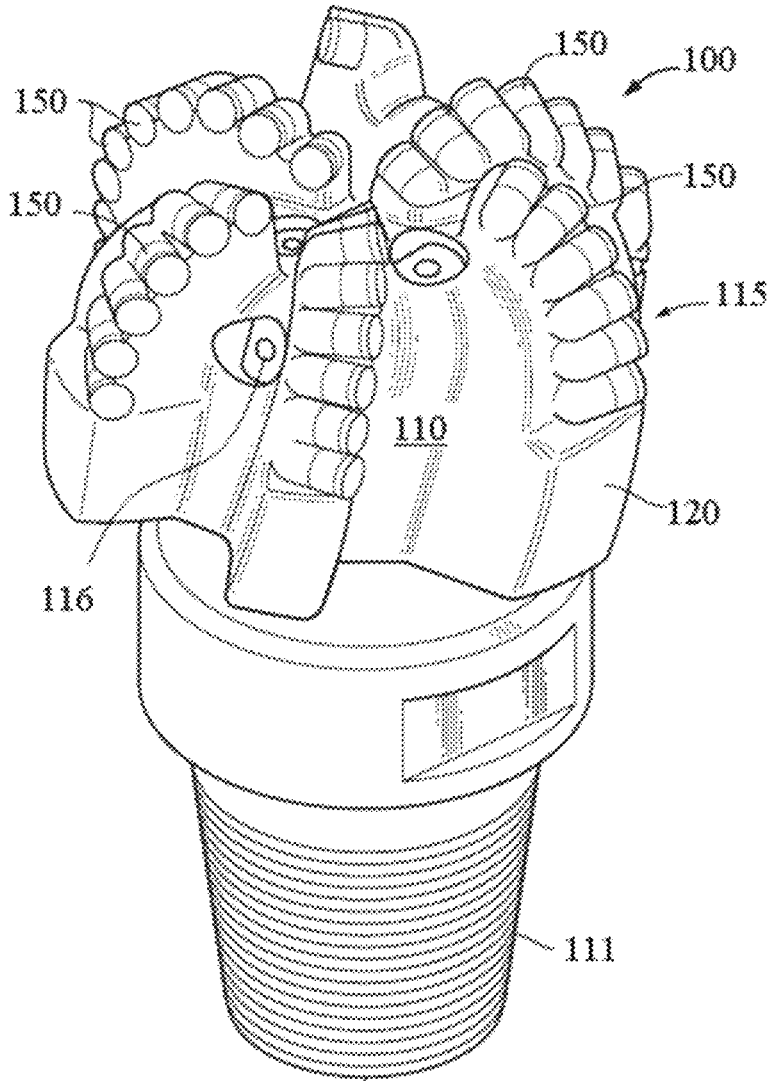
FIG. 13 shows a fixed cutter drill bit.
Figure 15:
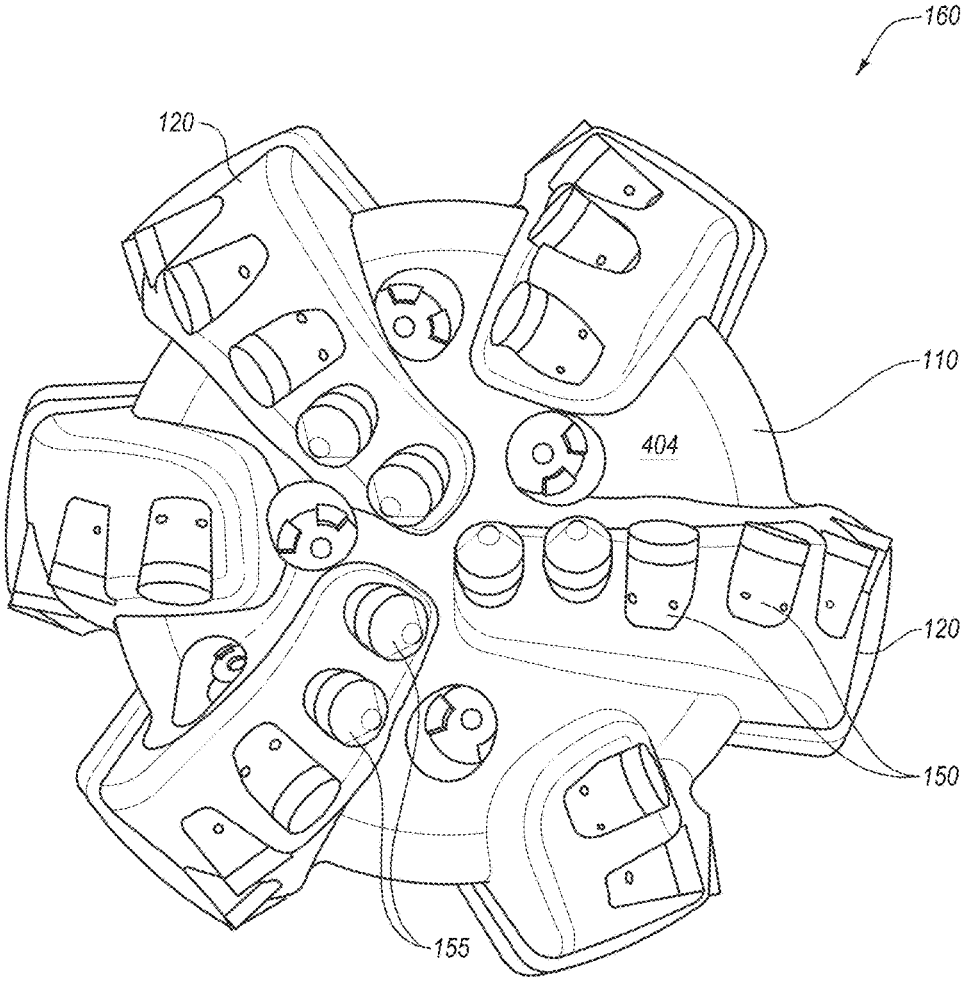
FIG. 15 shows a fixed cutter drill bit.

Referring now to FIG. 13, a fixed cutter drill bit 160 is shown. As shown, the drill bit 160 includes a bit body 110 having a threaded upper pin end 111 and a cutting end 115. The cutting end 115 may include a plurality of ribs or blades 120 arranged about the rotational axis (also referred to as the longitudinal or central axis) of the drill bit and extending radially outward from the bit body 110. Cutting elements 150 are embedded in the blades 120 at predetermined angular orientations and radial locations and with a desired back rake angle and side rake angle against a formation to be drilled. Such cutting elements may include shear cutters with planar or substantially planar upper surfaces (as illustrated in FIG. 1) as well as cutting elements having a substantially pointed cutting end, as illustrated in FIGS. 5-10. Such a bit 160 having a hybrid arrangement of shear cutters 150 and substantially pointed cutting elements 155 on blades 120 is shown, for example in FIG. 15.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 160, the blades 120 and the cutters 150. The drilling fluid also cleans and removes the cuttings as the drill bit 160 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 160 toward the surface of a wellbore (not shown).

Figure 14:
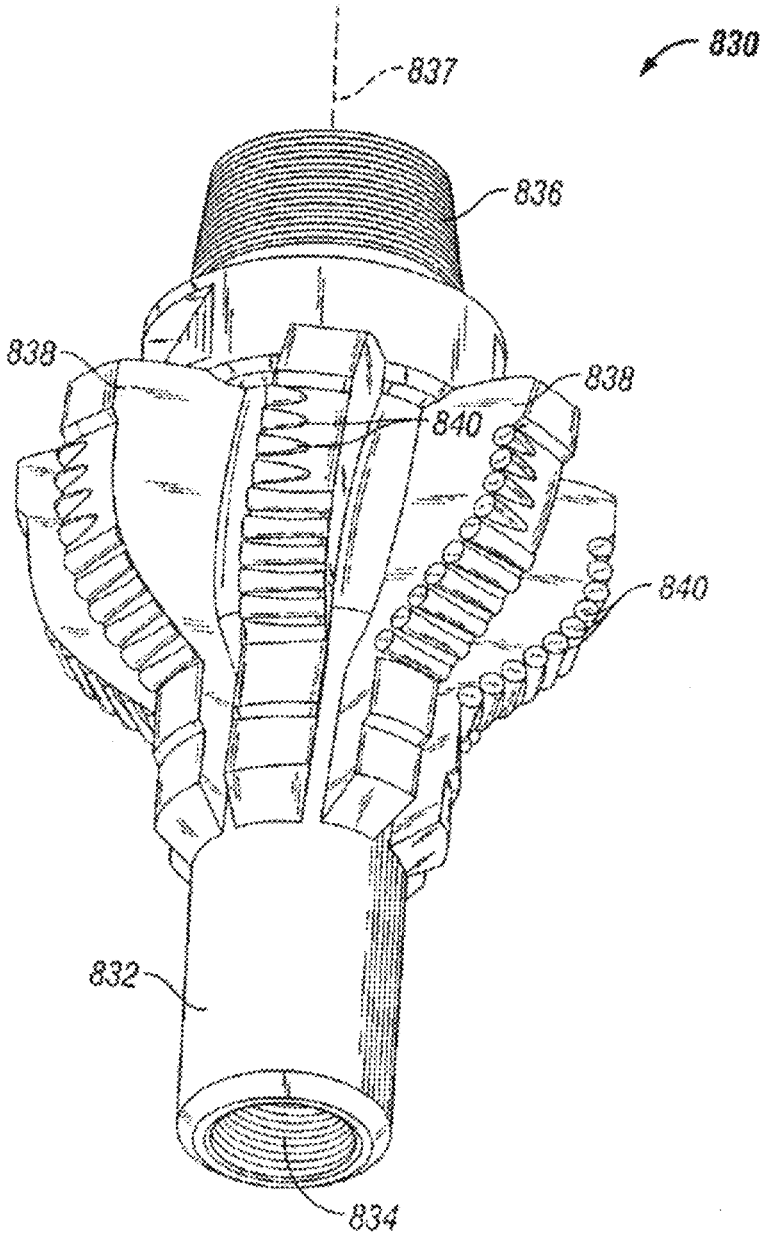
FIG. 14 shows a hole enlargement tool.

As described throughout the present disclosure, the cutting elements may be used on a variety of drill bit types. However, it is also within the scope of the present disclosure that the cutting elements may be included on a hole opener as well as other downhole cutting tools. FIG. 14 shows a general configuration of a hole opener 830 that includes one or more cutting elements of the present disclosure. The hole opener 830 includes a tool body 832 and a plurality of blades 838 disposed at selected azimuthal locations about a circumference thereof. The hole opener 830 generally comprises connections 834, 836 (e.g., threaded connections) so that the hole opener 830 may be coupled to adjacent drilling tools that include, for example, a drillstring and/or bottom hole assembly (BHA) (not shown). The tool body 832 generally includes a bore therethrough so that drilling fluid may flow through the hole opener 830 as it is pumped from the surface (e.g., from surface mud pumps (not shown)) to a bottom of the wellbore (not shown). The blades 838 shown in FIG. 14 are spiral blades and are generally positioned at substantially equal angular intervals about the perimeter of the tool body, i.e., the hole opener 830. This arrangement is not a limitation on the scope of the disclosure, but rather is used merely for illustrative purposes. Those having ordinary skill in the art will recognize that any downhole cutting tool (including mills or stabilizers) or other cutting tools used for example in construction and mining tools, such as road grooving tools, mining picks, etc. may be used.

Although only a few example embodiments have been described in detail above, those skilled in the art will readily appreciate that many modifications are possible in the example embodiments without materially departing from this disclosure. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed:

1. A cutting element, comprising:

a substrate comprising a plurality of metal carbide particles and a first metal binder having a first metal binder content;

an outer layer of polycrystalline diamond material at an end of the cutting element, the polycrystalline diamond material comprising:

a plurality of interconnected diamond particles; and a plurality of interstitial regions disposed among the interconnected diamond particles, the plurality of interstitial regions contain a second metal binder having a second metal binder content; and at least one transition zone between the substrate and the outer layer, the at least one transition zone comprising a plurality of refractory metal carbide particles and a third metal binder having a third metal binder content, the third metal binder content being less than the first metal binder content and the second metal binder content, the at least one transition zone comprises a diamond content of less than 5 wt %, a refractory metal carbide content of up to 95 wt %, and the third metal binder content is about 1 to 2 wt %.

2. The cutting element of claim 1, wherein the at least one transition zone has a first thickness, at its thickest point, less than a second thickness, at its thickest point, of the outer layer.

3. The cutting element of claim 2, wherein the second thickness is at least twice the first thickness.

4. The cutting element of claim 1, wherein the outer layer of polycrystalline diamond material has a non-planar upper surface.

5. The cutting element of claim 4, wherein the non-planar upper surface terminates in a rounded apex.

6. The cutting element of claim 1, wherein the at least one transition zone comprises at least two transition zones, wherein one of the at least two transition zones is adjacent the outer layer and comprises a diamond content of greater than 10 wt %, a refractory metal carbide content of less than 89 wt %, and a fourth metal binder having a fourth metal binder content of about 1 to 8 wt %.

7. The cutting element of claim 1, wherein the polycrystalline diamond material further comprises a refractory metal disposed in the plurality of interstitial regions.

8. The cutting element of claim 7, wherein the polycrystalline diamond material comprises a diamond content of up to 95 wt %, the second metal binder content is at least 5 wt %, and a refractory metal content of up to 5 wt %.

9. The cutting element of claim 1, wherein the substrate comprises a metal carbide content of at least 85 wt % and the first metal binder content is at least 6 wt %.

10. The cutting element of claim 1, wherein the refractory metal of the refractory metal carbide is at least one selected from the group consisting of W, Ti, Ta, Nb, Zr, and mixtures thereof.

11. The cutting element of claim 1, wherein the plurality of interconnected diamond particles have a mean particle size of about 0.5 to 100 microns.

12. The cutting element of claim 1, wherein the at least one transition zone has a higher hardness and a higher strength than the substrate.

13. A downhole cutting tool, comprising:

a tool body, and at least one cutting element recited in claim 1 fixed to the tool body.

14. The cutting element of claim 1, wherein the plurality of refractory metal carbide particles have a particle size of less than 10 microns.

15. The cutting element of claim 14, wherein the plurality of refractory metal carbide particles are formed in situ and have a resulting particle size of up to 8 microns.

* * * * *